US010393135B2

(12) United States Patent
Montgomery et al.

(10) Patent No.: US 10,393,135 B2
(45) Date of Patent: Aug. 27, 2019

(54) COMPRESSOR BLADE LOCKING MECHANISM IN DISK WITH AXIAL GROOVE

(71) Applicant: Doosan Heavy Industries & Construction Co., Ltd., Gyeongsangnam-do (KR)

(72) Inventors: Matthew Montgomery, Gyeongnam (KR); Iurii Goroshchak, Gyeongnam (KR); Joohwan Kwak, Gyeongnam (KR)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 264 days.

(21) Appl. No.: 15/428,799

(22) Filed: Feb. 9, 2017

(65) Prior Publication Data

US 2018/0223859 A1 Aug. 9, 2018

(51) Int. Cl.
*F04D 29/32* (2006.01)
*F01D 5/30* (2006.01)

(52) U.S. Cl.
CPC ..... *F04D 29/322* (2013.01); *F01D 5/3015* (2013.01); *F04D 29/324* (2013.01)

(58) Field of Classification Search
CPC ..... F04D 29/34; F04D 29/322; F04D 29/324; F01D 5/3015; F01D 5/3007
See application file for complete search history.

(56) References Cited

U.S. PATENT DOCUMENTS 3,266,770 A * 8/1966 Harlow ..... F01D 5/081 416/174
4,033,705 A * 7/1977 Luebering ..... F01D 5/3015 416/220 R (Continued)

FOREIGN PATENT DOCUMENTS

EP 0717168 B1 7/1998
JP S62-047703 U 3/1987

(Continued)

OTHER PUBLICATIONS

A Korean Office Action dated Mar. 28, 2019 in connection with Korean Patent Application No. 10-2018-0007926 which corresponds to the above-referenced U.S. application.

*Primary Examiner* — Jason D Shanske
*Assistant Examiner* — Eric J Zamora Alvarez
(74) *Attorney, Agent, or Firm* — Invenstone Patent, LLC

(57) ABSTRACT

A compressor bladed disk comprises a disk including an axial groove and a disk protrusion, a compressor blade including an attachment engaged with the axial groove of the disk, and a first locking plate disposed on the disk and the attachment, wherein the attachment includes an upstream surface and an upstream fillet connected to the upstream surface, wherein the upstream surface of the attachment and a protrusion front surface of the disk protrusion are aligned with each other, wherein a back surface of the first locking plate is disposed on the upstream surface of the attachment and the protrusion front surface of the disk protrusion, and wherein the first locking plate is disposed on the upstream fillet. The compressor bladed disk further comprises a second locking plate disposed on a downstream surface of the attachment.

16 Claims, 10 Drawing Sheets

(56) References Cited

U.S. PATENT DOCUMENTS

| | | | | | |
|---|---|---|---|---|---|
| 5,112,193 | A * | 5/1992 | Greer | F01D 5/3015 | 416/220 R |
| 5,169,289 | A * | 12/1992 | Lalanne | F01D 5/3015 | 416/219 R |
| 5,257,909 | A * | 11/1993 | Glynn | F01D 5/3015 | 416/219 R |
| 5,350,279 | A | 9/1994 | Prentice et al. | | |
| 5,628,621 | A * | 5/1997 | Toborg | F01D 5/066 | 416/198 A |
| 5,906,096 | A | 5/1999 | Siga et al. | | |
| 6,457,942 | B1 | 10/2002 | Forrester | | |
| 6,506,016 | B1 * | 1/2003 | Wang | F01D 5/147 | 415/173.7 |
| 7,500,832 | B2 * | 3/2009 | Zagar | F01D 5/3015 | 416/220 R |
| 7,686,585 | B2 | 5/2010 | Buisson et al. | | |
| 8,469,670 | B2 | 6/2013 | Fulayter et al. | | |
| 9,376,926 | B2 | 6/2016 | Anderson et al. | | |
| 2008/0273982 | A1 | 11/2008 | Chunduru et al. | | |

FOREIGN PATENT DOCUMENTS

| | | | |
|---|---|---|---|
| JP | H04-134604 | U | 12/1992 |
| JP | 2010-180879 | A | 8/2010 |

* cited by examiner

COMPRESSOR BLADE LOCKING MECHANISM IN DISK WITH AXIAL GROOVE

BACKGROUND

The present invention relates to a compressor for a gas turbine, more particularly, to a compressor blade locking device for a compressor blade engaged in an axial groove of a disk. A gas turbine generally comprises a compressor, a combustor, and a turbine, wherein the compressor provides compressed air generated by a compressor blade to the combustor. During operation of the compressor, while the compressor blade is radially retained by a dovetail joint structure of an attachment of the compressor blade and an axial groove of a disk of the compressor, axial retention of the compressor blade requires an additional locking device because the axial groove of the disk has open ends in an axial direction. As the additional locking device, a longitudinal wedge is inserted between the attachment of the compressor blade and the axial groove of the disk or a plate is provided in front of the attachment of the compressor blade. However, while axial force of the compressor blade is very large, the above locking devices do not effectively relieve a stress of the axial force and require a complicated structure. In addition, these techniques increase the number of required parts and make the manufacturing process complicated.

BRIEF SUMMARY

Exemplary embodiments of the subject invention relate to a compressor blade locking device that substantially obviates one or more of the above disadvantages/problems and provides one or more of the advantages as mentioned below. In many embodiments, a compressor blade locking device comprises a first locking plate disposed on an upstream surface of an attachment of a compressor blade.

In one embodiment, a compressor blade locking device includes an attachment configured to be engaged in a groove of a disk, a first locking plate disposed on an upstream surface of the attachment, and a second locking plate disposed on a downstream surface of the attachment.

In another embodiment, a compressor bladed disk comprises a disk including an axial groove and a disk protrusion, a compressor blade including an attachment engaged with the axial groove of the disk, and a first locking plate disposed on the disk and the attachment, wherein an upstream surface of the attachment and a protrusion front surface of the disk protrusion are aligned with each other, and wherein a back surface of the first locking plate is disposed on the upstream surface of the attachment and the protrusion front surface of the disk protrusion.

In another embodiment, a gas turbine comprises a compressor, a combustor receiving compressed air from the compressor, and a turbine receiving combusted gas from the combustor, wherein the compressor comprises a first compressor bladed disk connected to a front shaft, and a second compressor bladed disk connected to the first compressor bladed disk through a torque coupling ring of the first compressor bladed disk, and wherein the first compressor bladed disk comprises a disk including an axial groove and a disk protrusion and coupled with the front shaft, a compressor blade including an attachment engaged with the axial groove of the disk, a first locking plate disposed on an upstream surface of the attachment, and a second locking plate disposed on a downstream surface of the attachment.

DETAILED DISCLOSURE

Figure 1:
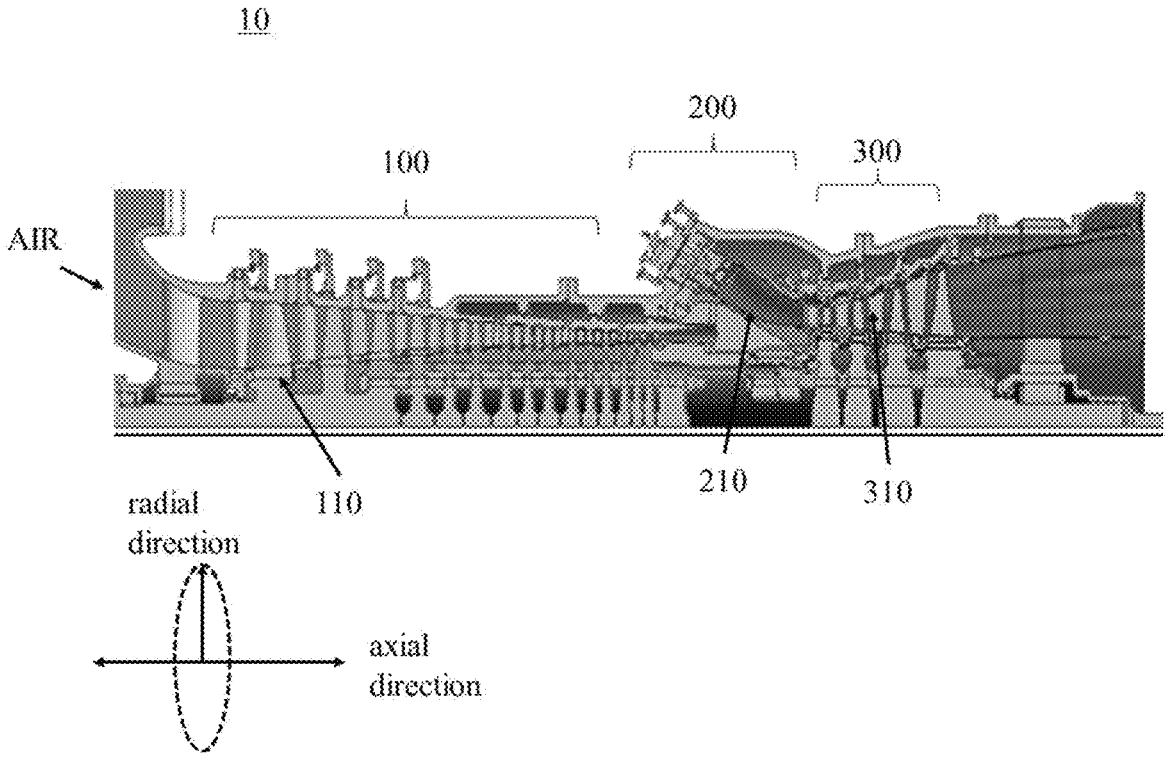
FIG. 1 is a cross-sectional view of a gas turbine according to an embodiment of the subject invention.

When the term "on" or "over" are used herein, when referring to layers, regions, patterns, or structures, it is understood that the layer, region, pattern, or structure can be directly on another layer or structure, or intervening layers, regions, patterns, or structures may also be present. When the terms "under" or "below" are used herein, when referring to layers, regions, patterns, or structures, it is understood that the layer, region, pattern, or structure can be directly under the other layer or structure, or intervening layers, regions, patterns, or structures may also be present.

In addition, references to "first", "second", and the like (e.g., first and second portion), as used herein, and unless otherwise specifically stated, are intended to identify a particular feature of which there may be more than one. Such reference to "first" does not imply that there must be two or more. These references are not intended to confer any order in time, structural orientation, or sidedness (e.g., left or right) with respect to a particular feature, unless explicitly stated. In addition, the terms "first" and "second" can be selectively or exchangeably used for the members.

Furthermore, "exemplary" is merely meant to mean an example, rather than the best. It is also to be appreciated that features, layers and/or elements depicted herein are illustrated with particular dimensions and/or orientations relative to one another for purposes of simplicity and ease of understanding, and that the actual dimensions and/or orientations may differ substantially from that illustrated. That is, a dimension of each of the elements may be exaggerated for clarity of illustration, and the dimension of each of the elements may be different from an actual dimension of each of the elements. Not all elements illustrated in the drawings must be included and limited to the present disclosure, but the elements except essential features of the present disclosure may be added or deleted.

It is to be understood that the figures and descriptions of embodiments of the present invention have been simplified to illustrate elements that are relevant for a clear understanding of the invention, while eliminating (in certain cases), for purposes of clarity, other elements that may be well known. Those of ordinary skill in the art will recognize that other elements may be desirable and/or required in order to implement the present invention. However, because such elements are well known in the art, and because they do not facilitate a better understanding of the present invention, a discussion of such elements is not provided herein.

Reference will be made to the attached figures on which the same reference numerals are used throughout to indicate the same or similar components. With reference to the attached figures, which show certain embodiments of the subject invention, it can be seen in FIG. 1 that, in an embodiment, a gas turbine 10 includes a compressor 100 having a compressor blade 110, a combustor 200 having a combustion chamber 210, and a turbine 300 having a turbine blade 310. Air is provided according to the arrow direction to the compressor blade 110 and compressed in the compressor 100, and then the compressed air is provided to the combustor 200. The air may pass through several compressor blades 110 located in several stages in an axial direction and be gradually compressed. The compressed air provided by the compressor 100 is combusted with a fuel in the combustion chamber 210, thereby producing a hot gas. The hot gas generated in the combustion chamber 210 is supplied to the turbine blade 310 such that the turbine blade 310 turns.

Figure 2A:
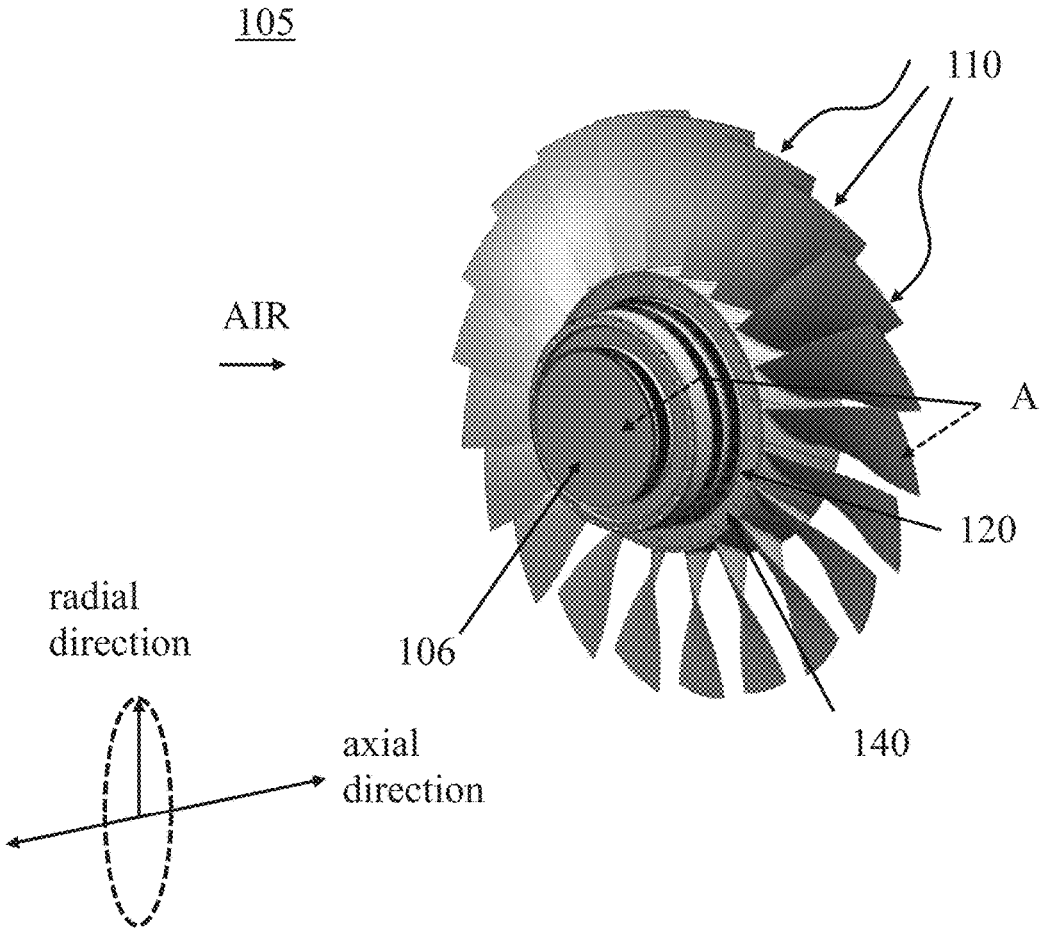
FIGS. 2(*a*) and 2(*b*) are front and rear perspective views, respectively, of a compressor bladed disk according to a first embodiment of the subject invention.
Figure 2B:
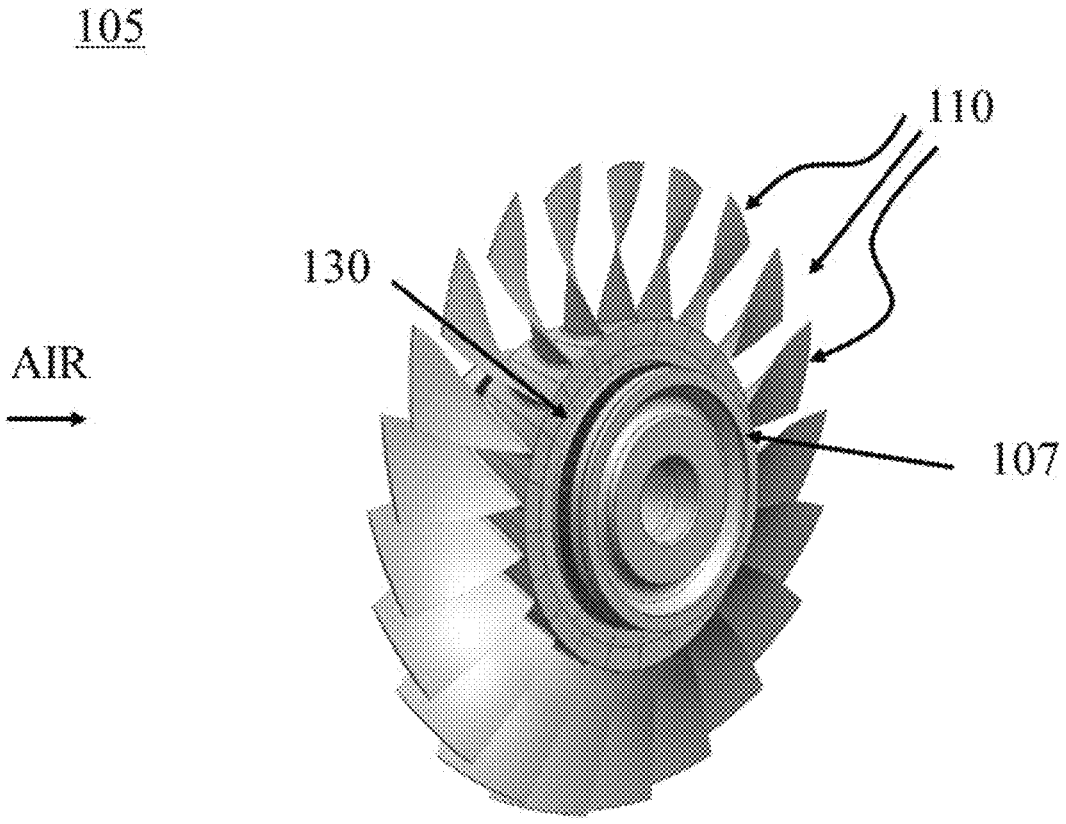

FIGS. 2(*a*) and 2(*b*) are front and rear perspective views, respectively, of a compressor bladed disk according to a first embodiment of the subject invention. A compressor bladed disk 105 can be used in any stage in the compressor 100 and the compressor bladed disk 105 can be coupled with another compressor bladed disk 105. For example, FIGS. 2(*a*) and 2(*b*) show the compressor bladed disk 105 used in the first stage of the compressor 100.

The compressor bladed disk 105 includes a disk 140 having a rim shape, a compressor blade 110 engaged with the disk 140, a first locking plate 120 disposed on the disk 140 and the compressor blade 110 at an upstream side of the compressor blade 110, and a second locking plate 130 disposed on the disk 140 and the compressor blade 110 at a downstream side of the compressor blade 110, wherein the air flows from the upstream side to the downstream side. In addition, the compressor bladed disk 105 of the first stage is connected to the front shaft 106 at the upstream side and coupled with another compressor bladed disk 105 of the second stage through a torque coupling ring 107 at the downstream side. A compressor bladed disk 105 used in the middle stage may include a torque coupling ring 107 at both upstream and downstream sides for connecting other compressor bladed disks 105.

Figure 3:
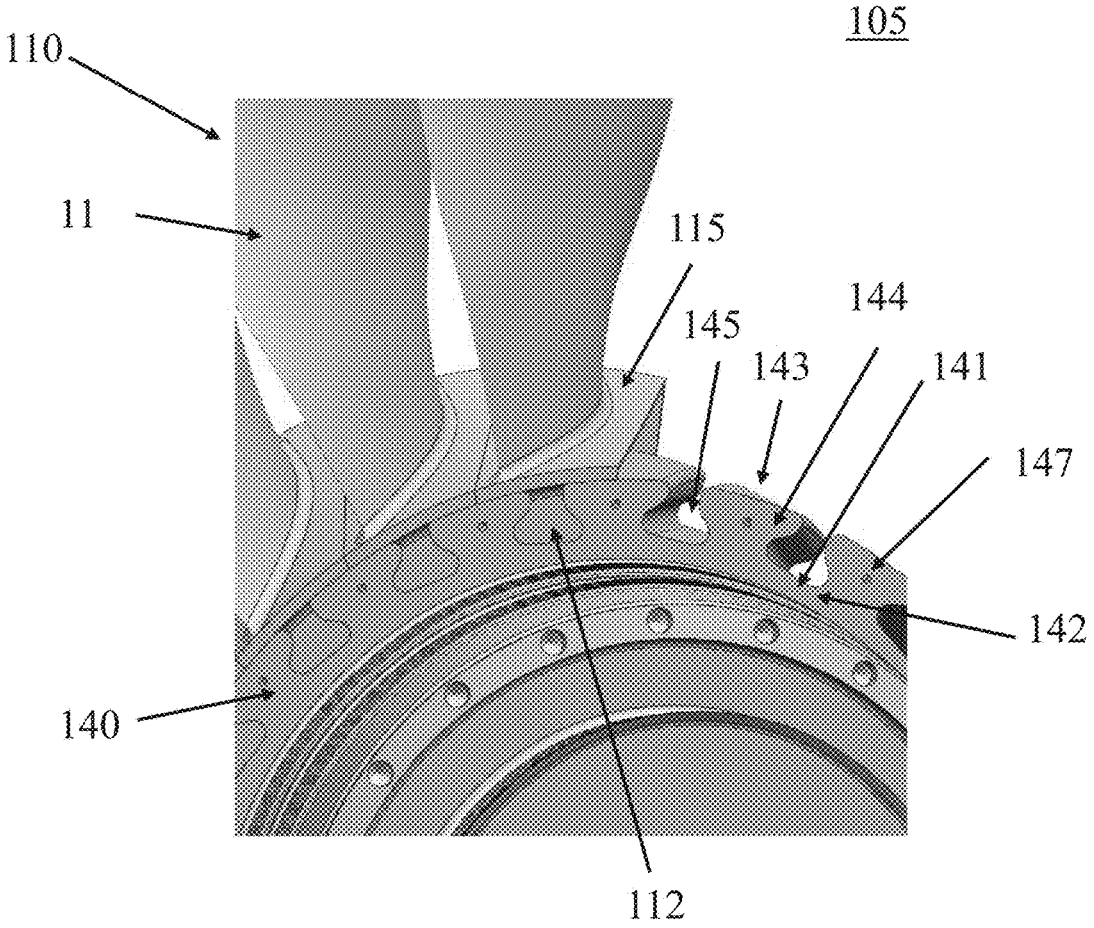
FIG. 3 is a partial perspective view of a compressor bladed disk according to a first embodiment of the subject invention.

FIG. 3 shows a partial perspective view of a compressor bladed disk according to a first embodiment of the subject invention. Referring to FIG. 3, a plurality of compressor blades 110 are engaged in the circumference of the disk 140 in such a manner that the plurality of compressor blades 110 are located adjacent to each other and cover the circumference of the disk 140. Each of the compressor blades 110 includes an attachment 112 configured to be engaged with the disk 140, an upper platform 115 disposed on the attachment 112, and an airfoil 117 disposed on the upper platform 115 and facing the air.

The disk 140 includes a rim 141 having a rim front surface 142 at the upstream side, a plurality of disk protrusions 143 protruded from the rim 141 in a radial direction, and a plurality of axial grooves 145 between the disk protrusions 143. The axial groove 145 is open at the upstream side and the downstream side such that the attachment 112 of the compressor blade 110 is engaged with the axial groove 145 like a dovetail joint structure. In case the disk 140 turns, a radial disengagement of the compressor blade 110 from the disk 140 is prevented by the dovetail joint structure between the attachment 112 and the axial groove 145. However, this open axial groove 145 allows the attachment 112 of the compressor blade 110 to move in the axial direction and requires a blocking device to inhibit the attachment 112 from moving in the axial direction.

The disk protrusion 143 includes a disk hole 147 configured to be coupled with a bolt at a protrusion front surface 144. The protrusion front surface 144 of the disk protrusion 143 is aligned with the rim front surface 142 of the rim 141 in the radial direction, thereby allowing the first locking plate 120 of FIG. 2(*a*) to be in contact with the protrusion front surface 144 and the rim front surface 142 at the same time.

Figure 4:
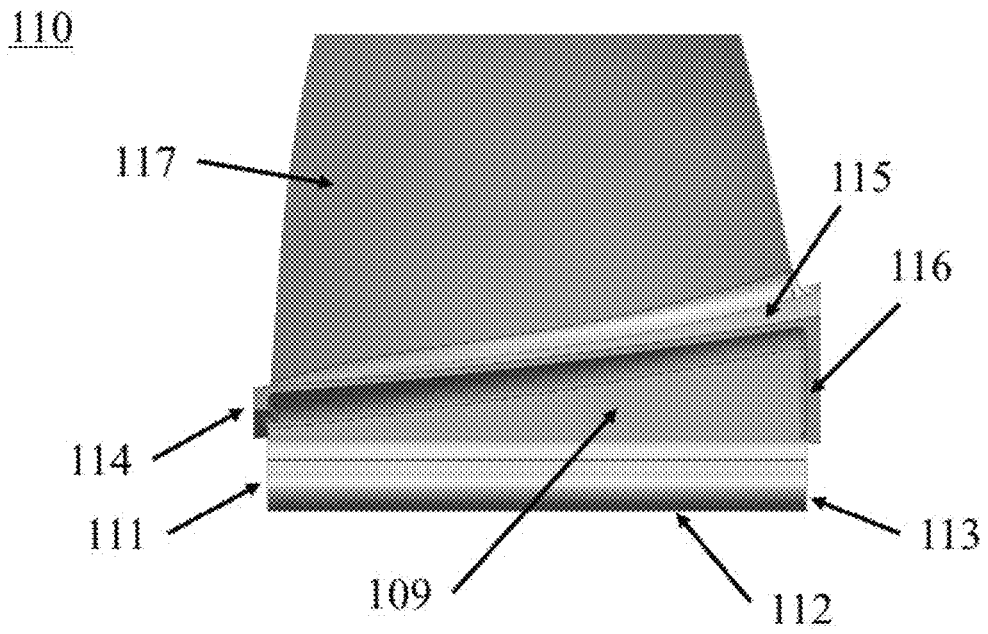
FIG. 4 is a side view of a compressor blade according to a first embodiment of the subject invention.

FIG. 4 is a side view of a compressor blade according to a first embodiment of the subject invention. As set forth above, the compressor blade 110 includes an attachment 112 configured to be engaged with the disk 140, an upper platform 115 disposed on the attachment 112, and an airfoil 117 disposed on the upper platform 115. In addition, the compressor blade 110 further includes an attachment plate 109 disposed between the attachment 112 and the upper platform 115, an upstream platform 114 disposed on the upper platform 115 at the upstream side, and a downstream platform 116 disposed on the upper platform 115 at the downstream side. A distal end of the upstream platform 114 extends more upstream than does an upstream surface 111 of the attachment 112 in the axial direction, and a distal end of the downstream platform 116 extends more downstream than does a downstream surface 113 of the attachment 112 in the axial direction. That is, the upstream platform 114 is protruded against the upstream surface 111 of the attachment 112 and the downstream platform 116 is protruded against the downstream surface 113 of the attachment 112.

A width of the attachment plate 109 in the radial direction is narrow at the upstream side and wide at the downstream side, thereby making the airfoil 117 and the upper platform 115 close to the attachment 112 at the upstream side and far from the attachment 112 at the downstream side. The length of the downstream platform 116 in the radial direction is longer than that of the upstream platform 114, thus an end portion of the downstream platform 116 is closer to the attachment 112 than that of the upstream platform 114 in the radial direction perpendicular to the axial direction.

Figure 5:
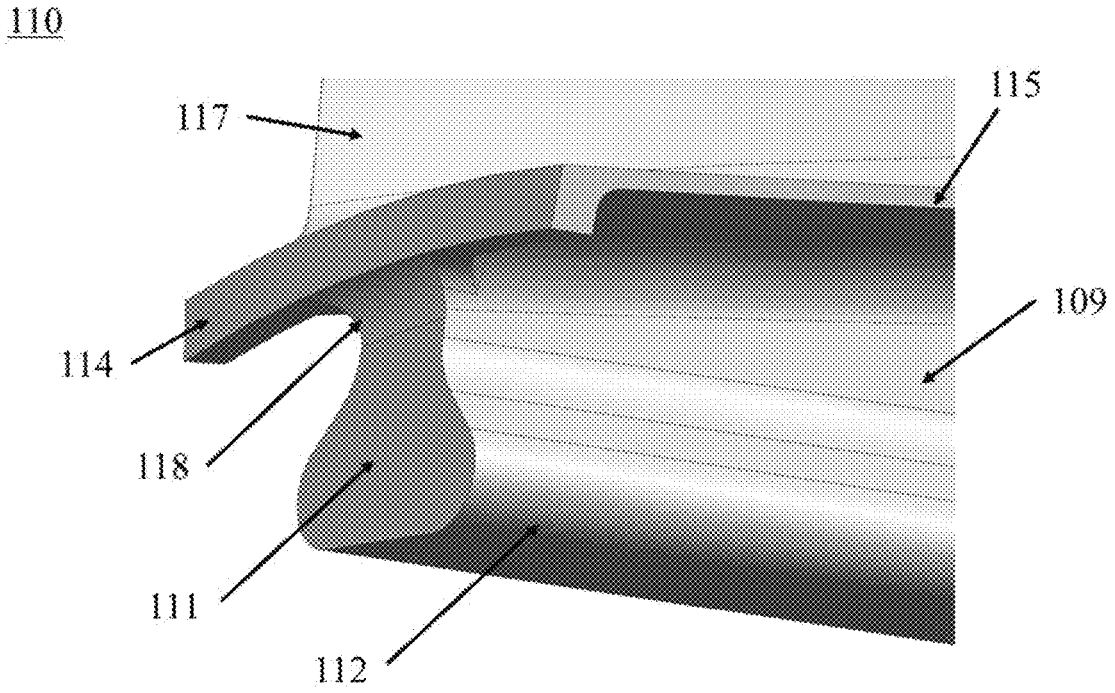
FIG. 5 is a perspective view of a compressor blade according to a first embodiment of the subject invention.

FIG. 5 is a perspective view of a compressor blade according to a first embodiment of the subject invention. Referring to FIG. 5, the upstream platform 114 is connected to the upstream surface 111 of the attachment 112 through an upstream fillet 118 which distributes evenly a stress to the compressor blade 110. In addition, the upstream platform 114 has an arc shape when viewed from the axial direction such that the upstream platform 114 corresponds to the first locking plate 120 of FIG. 2.

Figure 6:
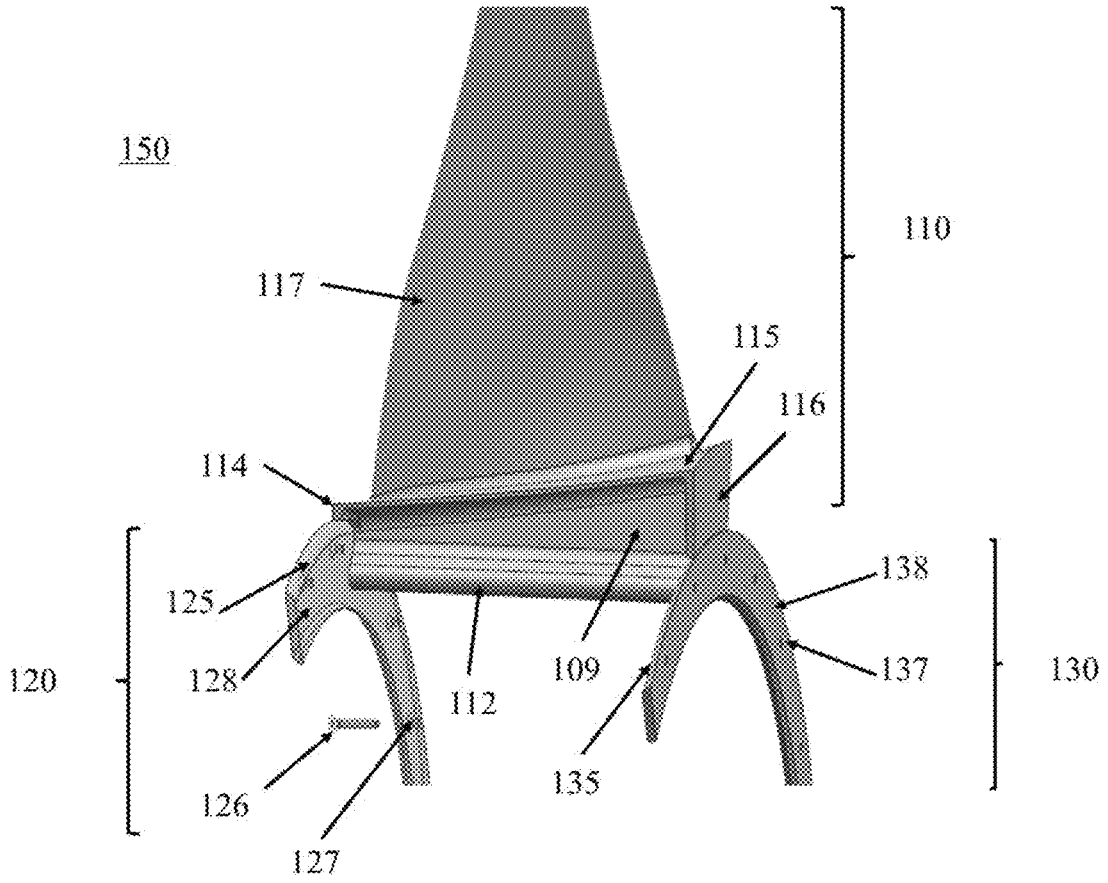
FIG. 6 is a perspective view of a compressor blade locking device according to a first embodiment of the subject invention.

FIG. 6 is a perspective view of a compressor blade locking device according to a first embodiment of the subject invention. Referring to FIG. 6, a compressor blade locking device 150 comprises the compressor blade 110, the first locking plate 120 disposed on the compressor blade 110 at the upstream side, and the second locking plate 130 disposed on the compressor blade 110 at the downstream side.

The first locking plate 120 includes a first annular plate 128 having an arc shape and disposed on the attachment 112, and the first annular plate 128 includes a first curved surface 125 and a first locking plate hole 127 configured to be coupled with a bolt 126. Similar to the first locking plate 120, the second locking plate 130 includes a second annular plate 138, wherein the second annular plate 138 includes a second curved surface 135 and a second locking plate hole 137.

Figure 7:
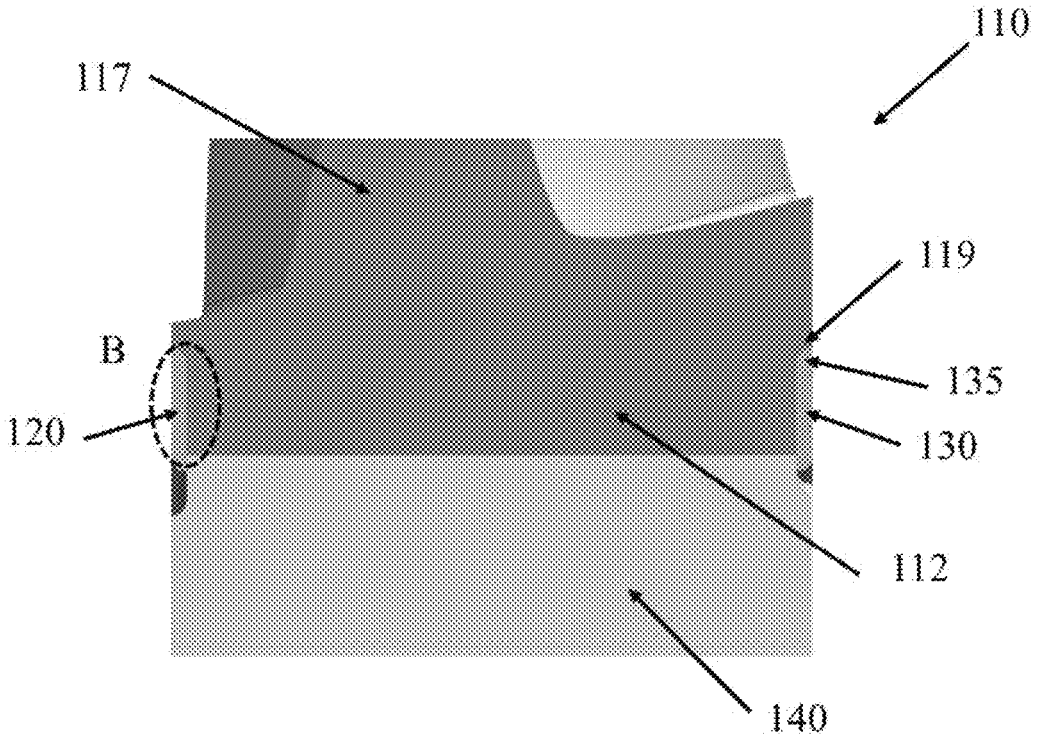
FIG. 7 is a cross-sectional view of a compressor bladed disk according to a first embodiment of the subject invention.
Figure 8:
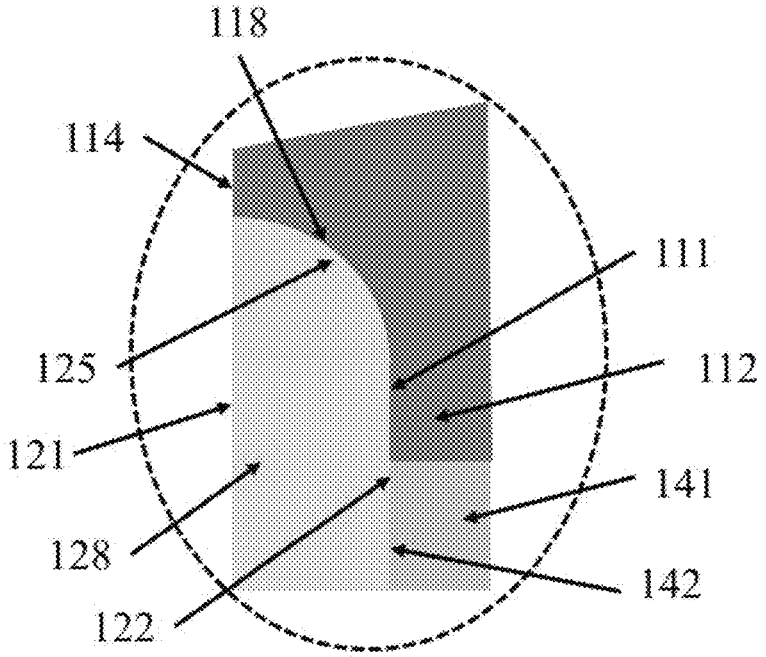
FIG. 8 is an enlarged cross-sectional view illustrating portion "B" in FIG. 7.

FIG. 7 is a cross-sectional view of a compressor bladed disk according to a first embodiment of the subject invention, and FIG. 8 is an enlarged cross-sectional view illustrating portion "B" in FIG. 7, FIG. 7 shows the cross-section image cut in the radial direction according to the line "A" in FIG. 2(*a*), wherein the compressor blade locking device 150 including the compressor blade 110 and the first 120 and second 130 locking plates is engaged with the disk 140.

Referring to FIGS. 7 and 8, the first locking plate 120 is disposed on the attachment 112 and the disk 140 at the upstream side and the second locking plate 130 is disposed on the attachment 112 and the disk 140 at the downstream side. A back surface 122 of the first annular plate 128 of the first locking plate 120 is in contact with a rim front surface 142 of the rim 141 of the disk 140 and the upstream surface 111 of the attachment 112 at the same time. The first curved surface 125 corresponds to the upstream fillet 118 and is in contact with the upstream fillet 118. This coupled structure of the first curved surface 125 and the upstream fillet 118 distributes evenly the stress between the first locking plate 120 and the compressor blade 110. In addition, a distal end of the upstream platform 114 is aligned with a front surface 121 of the first annular plate 128 in the radial direction perpendicular to the axial direction. The second locking plate 130 similarly includes a second annular plate 138 and a second curved surface 135 corresponding to a downstream fillet 119.

Referring to FIGS. 2-8, the first locking plate 120 is fastened with the disk 140 by the bolt 126 passing through the first locking plate hole 127 and the disk hole 147, and the second locking plate 130 is fastened with the disk 140 with another bolt (not shown) passing through the second locking plate hole 137. The first locking plate 120 is in contact with the rim front surface 142 of the rim 141, the protrusion front surface 144 of the disk protrusion 143, and the upstream surface 111 of the compressor blade 110 at the same radial plane, and the first curved surface 125 of the first locking plate 120 is configured to correspond to the upstream fillet 118 of the compressor blade 110. Therefore, the first locking plate 120 and the second locking plate 130 inhibit the compressor blade 110 from being disengaged or moving in the axial direction and effectively distribute the stress between the compressor blade 110 and the locking plates 120 and 130.

The first locking plate 120 is a circular rim type or an arc type. While a plurality of arc type first locking plates are required in order to cover all rim front surface 142 of the disk 140, the arc type first locking plate provides an easy disassembly of the first locking plate 120 and the compressor blade 110 from the disk 140 when the compressor blade 110 has a problem. In addition, the longitudinal direction of the axial groove 145 may be inclined slightly against the axial direction.

Figure 9:
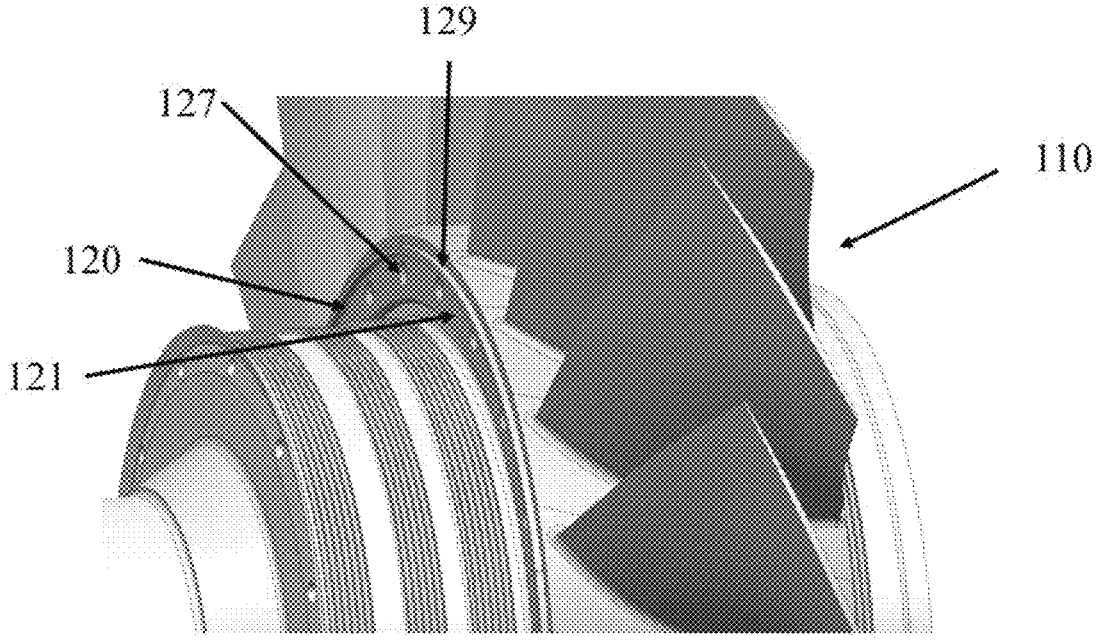
FIG. 9 is a perspective view of a compressor bladed disk according to a second embodiment of the subject invention.

FIG. 9 is a perspective view of a compressor bladed disk according to a second embodiment of the subject invention. The first locking plate 120 further includes a first shield portion 129 extended in the axial direction, thereby covering the front surface 121 and the first locking plate hole 127.

Figure 10:
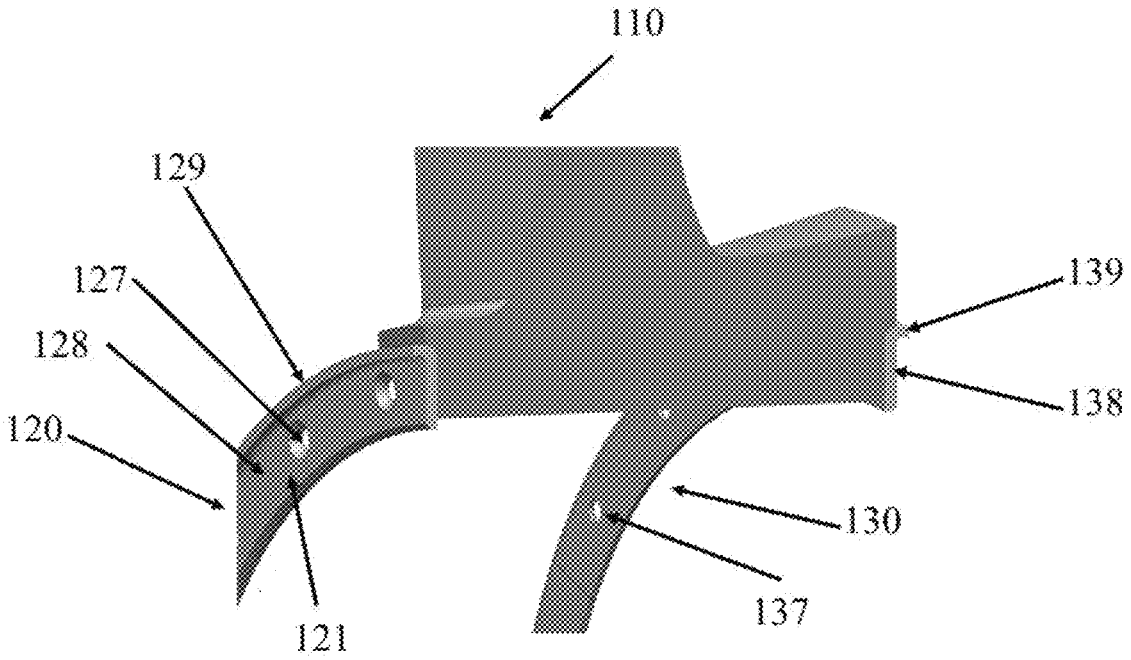
FIG. 10 is a cross-sectional perspective view of a compressor blade locking device according to a second embodiment of the subject invention.
Figure 11:
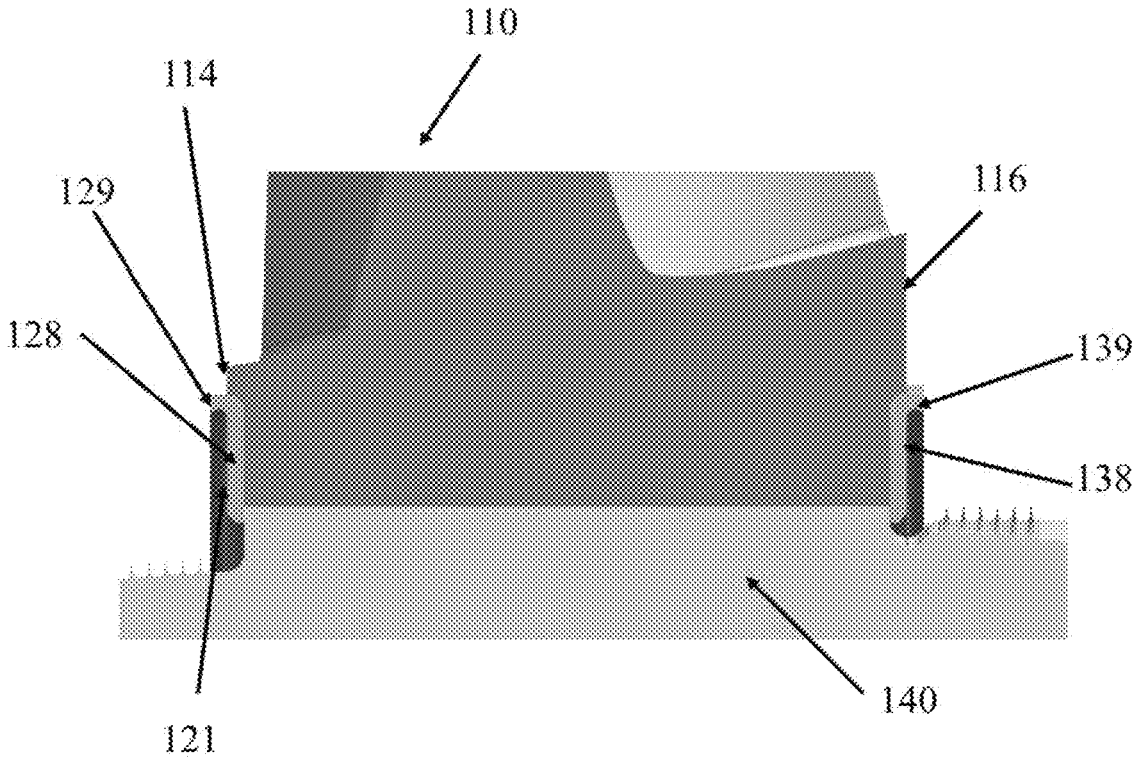
FIG. 11 is a cross-sectional view of a compressor bladed disk according to a second embodiment of the subject invention.

FIG. 10 is a cross-sectional perspective view of a compressor blade locking device according to a second embodiment of the subject invention. FIG. 11 is a cross-sectional view of a compressor bladed disk according to a second embodiment of the subject invention. Referring to FIGS. 10 and 11, the first shield portion 129 is extended from the first annular plate 128 in the axial direction and the first shield portion 129 is protruded in the axial direction against the upstream platform 114. As a result, the first shield portion 129 inhibits some parts from being introduced into the compressor blade 110 at the upstream side. For example, in case a bolt 126 coupled with the first locking plate hole 127 is broken, it is possible for the broken bolt to be introduced into the compressor blade 110 and to cause damage to the compressor blade 110. However, if the first shield portion 129 extended from the first annular plate 128 covers the front surface 121 and the first locking plate hole 127, the first shield portion 129 can protect the compressor blade 110 from the broken bolt.

The second locking plate 130 includes a second annular plate 138 and a second shield portion 139 extended from the second annular plate 138 in the axial direction. The second shield portion 139 is protruded against the downstream platform 116 and protects the compressor blade 110.

The subject invention includes, but is not limited to, the following exemplified embodiments.

Embodiment 1

A compressor blade locking device, comprising:

an attachment configured to be engaged in a groove of a disk;

a first locking plate disposed on an upstream surface and an upstream fillet of the attachment; and a second locking plate disposed on a downstream surface of the attachment.

Embodiment 2

The compressor blade locking device according to embodiment 1, wherein the groove of the disk is an axial groove.

Embodiment 3

The compressor blade locking device according to embodiment 1, further comprising an upper platform disposed on the attachment, an upstream platform disposed on the upper platform over the upstream surface, and a downstream platform disposed on the upper platform over the downstream surface.

Embodiment 4

The compressor blade locking device according to embodiment 3, wherein the upstream platform and the upstream surface are connected to each other through the upstream fillet.

Embodiment 5

The compressor blade locking device according to embodiment 4, wherein the first locking plate includes a first curved surface corresponding to the upstream fillet.

Embodiment 6

The compressor blade locking device according to embodiment 5, wherein a front surface of the first locking plate is aligned with the upstream platform at a radial direction perpendicular to an axial direction of the disk.

Embodiment 7

The compressor blade locking device according to embodiment 5, wherein the first locking plate comprises:

a first annular plate disposed on the upstream surface; and a first shield portion extended from the first annular plate.

Embodiment 8

The compressor blade locking device according to embodiment 7, wherein the first shield portion is protruded against the upstream platform in an axial direction of the disk.

Embodiment 9

A compressor bladed disk, comprising:

a disk including an axial groove and a disk protrusion;

a compressor blade including an attachment engaged with the axial groove of the disk; and a first locking plate disposed on the disk and the attachment, wherein the attachment includes an upstream surface and an upstream fillet connected to the upstream surface, wherein the upstream surface of the attachment and a protrusion front surface of the disk protrusion are aligned with each other, wherein a back surface of the first locking plate is disposed on the upstream surface of the attachment and the protrusion front surface of the disk protrusion, and wherein the first locking plate is disposed on the upstream fillet.

Embodiment 10

The compressor bladed disk according to embodiment 9, wherein the back surface of the first locking plate is in physical contact with the upstream surface of the attachment and the protrusion front surface of the disk protrusion.

Embodiment 11

The compressor bladed disk according to embodiment 9, wherein the disk includes a rim, the disk protrusion is protruded from the rim in a radial direction of the disk, and a rim front surface of the rim is aligned with the protrusion front surface of the disk protrusion.

Embodiment 12

The compressor bladed disk according to embodiment 11, wherein the disk protrusion includes a disk hole on the protrusion front surface.

Embodiment 13

The compressor bladed disk according to embodiment 12, further comprising a bolt, wherein the first locking plate includes a first locking plate hole, and the bolt passes through the first locking plate hole and the disk hole.

Embodiment 14

The compressor bladed disk according to embodiment 11, wherein the compressor blade comprises:

an upper platform disposed on the attachment;

an upstream platform disposed on the upper platform at upstream side; and an airfoil disposed on the upper platform.

Embodiment 15

The compressor bladed disk according to embodiment 14, wherein the upstream platform is connected to the upstream surface through the upstream fillet.

Embodiment 16

The compressor bladed disk according to embodiment 15, wherein the first locking plate includes a first curved surface corresponding to the upstream fillet.

Embodiment 17

The compressor bladed disk according to embodiment 16, further comprising a second locking plate disposed on a downstream surface of the attachment.

Embodiment 18

A gas turbine, comprising:

a compressor;

a combustor receiving compressed air from the compressor; and a turbine receiving combusted gas from the combustor, wherein the compressor comprises:

a first compressor bladed disk connected to a front shaft; and a second compressor bladed disk connected to the first compressor bladed disk through a torque coupling ring of the first compressor bladed disk, and wherein the first compressor bladed disk comprises:

a disk including an axial groove and a disk protrusion and coupled with the front shaft;

a compressor blade including an attachment engaged with the axial groove of the disk;

a first locking plate disposed on an upstream fillet of the attachment; and a second locking plate disposed on a downstream fillet of the attachment.

Embodiment 19

The gas turbine according to embodiment 18, wherein the turbine includes a turbine blade configured to receive the combusted gas from the combustor.

Embodiment 20

The gas turbine according to embodiment 19, wherein the first locking plate includes a first curved surface corresponding to the upstream fillet.

Embodiment 21

A compressor bladed disk, comprising:

a disk including an axial groove and a disk protrusion;

a compressor blade engaged with the disk; and a first locking plate disposed on the disk and the compressor blade, wherein the compressor blade includes an attachment engaged in the axial groove, an upper platform disposed on the attachment, an airfoil disposed on the upper platform, and an upstream platform disposed on the upper platform at upstream side, wherein an upstream surface of the attachment and a protrusion front surface of the disk protrusion are aligned with each other, and wherein a distal end of the upstream platform is protruded against the upstream surface and the protrusion front surface in an axial direction.

Embodiment 22

The compressor bladed disk according to embodiment 21, wherein the upstream platform is connected to the upstream surface through an upstream fillet.

Embodiment 23

The compressor bladed disk according to embodiment 22, wherein the upstream platform covers the first locking plate in a radial direction.

Embodiment 24

The compressor bladed disk according to embodiment 23, wherein the compressor blade further includes an attachment plate disposed between the attachment and the upper platform.

Embodiment 25

The compressor bladed disk according to embodiment 24, wherein the first locking plate includes a first annular plate disposed on the upstream surface and a first shield portion extended from the first annular plate in the axial direction.

Embodiment 26

The compressor bladed disk according to embodiment 24, further comprising a second locking plate disposed on the disk and the compressor blade at downstream side.

Embodiment 27

The compressor bladed disk according to embodiment 26, wherein the compressor blade further includes a downstream platform disposed on the upper platform at the downstream, and a distal end of the downstream platform is protruded against a downstream surface of the attachment in the axial direction.

It should be understood that the examples and embodiments described herein are for illustrative purposes only and that various modifications or changes in light thereof will be suggested to persons skilled in the art and are to be included within the spirit and purview of this application. Thus, the invention is not intended to limit the examples described herein, but is to be accorded the widest scope consistent with the principles and novel features disclosed herein.

What is claimed is:

1. A compressor blade locking device, comprising:

an attachment configured to be engaged in a groove of a disk;

a first locking plate disposed on an upstream surface and an upstream fillet of the attachment; and a second locking plate disposed on a downstream surface and a downstream fillet of the attachment, wherein the compressor blade locking device further comprises, an upstream platform disposed on an upper platform over the upstream surface, and a downstream platform disposed on the upper platform over the downstream surface, wherein the first locking plate includes a first curved surface corresponding to, and being in contact with, a first inverse curved surface of the upstream fillet, and the second locking plate includes a second curved surface corresponding to, and being in contact with, a second inverse curved surface of the downstream fillet, and wherein a length of the downstream platform in a radial direction of the disk perpendicular to an axial direction of the disk is longer than a length of the upstream platform, so that an end portion of the downstream platform is closer to the attachment than an end portion of the upstream platform in the radial direction.

2. The compressor blade locking device according to claim 1, wherein the groove of the disk is an axial groove.

3. The compressor blade locking device according to claim 1, further comprising the upper platform disposed on the attachment.

4. The compressor blade locking device according to claim 3, wherein the upstream platform and the upstream surface are connected to each other through the upstream fillet.

5. The compressor blade locking device according to claim 1, wherein a front surface of the first locking plate is aligned with the upstream platform at the radial direction.

6. The compressor blade locking device according to claim 1, wherein the first locking plate comprises:

a first annular plate disposed on the upstream surface; and a first shield portion extended from the first annular plate.

7. The compressor blade locking device according to claim 6, wherein the first shield portion is protruded against the upstream platform in the axial direction of the disk.

8. A compressor bladed disk, comprising:

a disk including an axial groove and a disk protrusion;

a compressor blade including an attachment engaged with the axial groove of the disk; and a first locking plate disposed on the disk and the attachment; and a second locking plate disposed on a downstream surface and a downstream fillet of the attachment, wherein the attachment includes an upstream surface and an upstream fillet connected to the upstream surface, wherein the upstream surface of the attachment and a protrusion front surface of the disk protrusion are aligned with each other, wherein a back surface of the first locking plate is disposed on the upstream surface of the attachment and the protrusion front surface of the disk protrusion, wherein the first locking plate is disposed on the upstream fillet, and wherein the compressor blade further comprises, an upper platform disposed on the attachment, an upstream platform disposed on the upper platform at the upstream surface, and a downstream platform disposed on the upper platform at the downstream surface, and wherein the first locking plate includes a first curved surface corresponding to, and being in contact with, a first inverse curved surface of the upstream fillet, and the second locking plate includes a second curved surface corresponding to, and being in contact with, a second inverse curved surface of the downstream fillet, and wherein a length of the downstream platform in a radial direction of the disk perpendicular to an axial direction of the disk is longer than a length of the upstream platform, so that an end portion of the downstream platform is closer to the attachment than an end portion of the upstream platform in the radial direction.

9. The compressor bladed disk according to claim 8, wherein the back surface of the first locking plate is in physical contact with the upstream surface of the attachment and the protrusion front surface of the disk protrusion.

10. The compressor bladed disk according to claim 8, wherein the disk includes a rim, the disk protrusion is protruded from the rim in the radial direction of the disk, and a rim front surface of the rim is aligned with the protrusion front surface of the disk protrusion.

11. The compressor bladed disk according to claim 10, wherein the disk protrusion includes a disk hole on the protrusion front surface.

12. The compressor bladed disk according to claim 11, further comprising a bolt, wherein the first locking plate includes a first locking plate hole, and the bolt passes through the first locking plate hole and the disk hole.

13. The compressor bladed disk according to claim 8, wherein the compressor blade comprises:

an airfoil disposed on the upper platform.

14. The compressor bladed disk according to claim 8, wherein the upstream platform is connected to the upstream surface through the upstream fillet.

15. A gas turbine, comprising:

a compressor;

a combustor receiving compressed air from the compressor; and a turbine receiving combusted gas from the combustor, wherein the compressor comprises:

a first compressor bladed disk connected to a front shaft; and a second compressor bladed disk connected to the first compressor bladed disk through a torque coupling ring of the first compressor bladed disk, and wherein the first compressor bladed disk comprises:

a disk including an axial groove and a disk protrusion and coupled with the front shaft;

a compressor blade including an attachment engaged with the axial groove of the disk;

a first locking plate disposed on an upstream fillet of the attachment; and a second locking plate disposed on a downstream fillet of the attachment, wherein the compressor blade further comprises, an upper platform disposed on the attachment, an upstream platform disposed on the upper platform at the upstream surface, and a downstream platform disposed on the upper platform at the downstream surface, and wherein the first locking plate includes a first curved surface corresponding to, and being in contact with, a first inverse curved surface of the upstream fillet, and the second locking plate includes a second curved surface corresponding to, and being in contact with, a second inverse curved surface of the downstream fillet, and wherein a length of the downstream platform in a radial direction of the disk perpendicular to an axial direction of the disk is longer than a length of the upstream platform, so that an end portion of the downstream platform is closer to the attachment than an end portion of the upstream platform in the radial direction.

16. The gas turbine according to claim 15, wherein the turbine includes a turbine blade configured to receive the combusted gas from the combustor.

* * * * *